US008002349B1

(12) United States Patent
Pizzuto

(10) Patent No.: US 8,002,349 B1
(45) Date of Patent: Aug. 23, 2011

(54) CHAIR PROVISION WITH AN APPARATUS FOR CONVERTING SOLAR ENERGY TO POWER ELECTRICAL DEVICES

(76) Inventor: Paul M. Pizzuto, Baldwin, NY (US)

( * ) Notice: Subject to any disclaimer, the term of this patent is extended or adjusted under 35 U.S.C. 154(b) by 0 days.

(21) Appl. No.: 12/658,465

(22) Filed: Feb. 8, 2010

(51) Int. Cl.
*A47C 31/00* (2006.01)

(52) U.S. Cl. ..... 297/217.3; 297/217.1; 297/184.11; 297/188.11; 297/188.05

(58) Field of Classification Search ..... 297/217.3, 297/217.1, 184.11, 184.1, 188.11, 188.17, 297/188.04, 188.05, 22, 54
See application file for complete search history.

(56) References Cited

U.S. PATENT DOCUMENTS

| | | | | | |
|---|---|---|---|---|---|
| 253,333 | A | * | 2/1882 | Armstrong | 297/19 |
| 1,655,860 | A | * | 1/1928 | Engquist | 297/135 |
| 2,337,955 | A | * | 12/1943 | Wright | 297/22 |
| D180,982 | S | | 9/1957 | Woodward | D6/336 |
| D183,790 | S | | 10/1958 | Deaton | D6/361 |
| D201,750 | S | | 7/1965 | Melchior | D6/335 |
| D220,690 | S | | 5/1971 | Ferro | D6/336 |
| 3,716,271 | A | * | 2/1973 | Kurz | 297/452.52 |
| 4,379,588 | A | * | 4/1983 | Speice | 297/217.3 |
| D284,394 | S | | 6/1986 | Bengtson et al. | D21/676 |
| D286,709 | S | | 11/1986 | Schultz | D6/361 |
| 4,715,652 | A | * | 12/1987 | Ward | 297/252 |
| D296,618 | S | | 7/1988 | Colby | D6/361 |
| 4,773,708 | A | * | 9/1988 | Nastu | 297/423.36 |
| 4,919,380 | A | * | 4/1990 | Ely, Jr. | 248/311.2 |
| 4,930,838 | A | * | 6/1990 | Brabant | 297/184.14 |
| 4,933,618 | A | * | 6/1990 | Ortlieb | 318/640 |
| 5,012,852 | A | * | 5/1991 | Blackhurst | 160/351 |
| 5,013,085 | A | | 5/1991 | Craig | 297/184.15 |
| 5,090,770 | A | | 2/1992 | Heinrichs et al. | |
| 5,211,172 | A | * | 5/1993 | McGuane et al. | 607/95 |
| 5,213,394 | A | | 5/1993 | Tattrie | 297/258.1 |
| 5,246,265 | A | * | 9/1993 | Nagan et al. | 297/54 |
| 5,331,956 | A | * | 7/1994 | Bailey | 128/202.13 |
| 5,524,957 | A | * | 6/1996 | Gibriano | 297/144 |
| 5,586,806 | A | * | 12/1996 | Hergott | 297/188.11 |
| 5,897,163 | A | * | 4/1999 | Singer | 297/217.7 |
| 5,908,218 | A | * | 6/1999 | Martin | 297/182 |
| 5,944,384 | A | * | 8/1999 | Patterson | 297/344.23 |
| 5,975,630 | A | * | 11/1999 | Schreiber | 297/217.3 |
| 6,059,365 | A | * | 5/2000 | Diamond | 297/354.13 |
| 6,145,926 | A | * | 11/2000 | Lin | 297/217.3 |
| 6,158,805 | A | * | 12/2000 | Blaney | 297/184.11 |
| 6,227,615 | B1 | * | 5/2001 | Newhouse et al. | 297/188.11 |
| 6,250,712 | B1 | * | 6/2001 | Livington et al. | 297/4 |
| 6,254,177 | B1 | * | 7/2001 | Tseng | 297/54 |
| D446,951 | S | | 8/2001 | Sheedy | D6/335 |
| D487,981 | S | | 4/2004 | Ludeke et al. | D6/356 |

(Continued)

FOREIGN PATENT DOCUMENTS

DE 19511753 A1 * 10/1996

(Continued)

*Primary Examiner* — Laurie Cranmer
(74) *Attorney, Agent, or Firm* — Richard L. Miller

(57) ABSTRACT

A chair provisioned with an apparatus for converting solar energy to power electrical devices which comprises the chair having a seat member and a backrest member to support a person thereon. A mechanism stored in the chair, is for converting the solar energy into electrical energy. At least one socket in the chair is electrically connected to the solar energy converting mechanism, wherein at least one of the electrical devices can plug into the at least one socket to receive the electrical energy therefrom.

8 Claims, 7 Drawing Sheets

U.S. PATENT DOCUMENTS

| | | | | |
|---|---|---|---|---|
| 6,737,830 | B2 | 5/2004 | Bean et al. | |
| 6,796,605 | B1 * | 9/2004 | Chu | 297/19 |
| 7,025,418 | B1 * | 4/2006 | Hackal | 297/217.3 |
| 7,207,622 | B2 * | 4/2007 | Cohan et al. | 297/31 |
| D545,580 | S | 7/2007 | Marin | D6/361 |
| D547,559 | S | 7/2007 | Ellacott | D6/361 |
| D565,315 | S | 4/2008 | Nielsen | D6/367 |
| D571,564 | S | 6/2008 | Schmidt | D6/335 |
| 7,407,178 | B2 * | 8/2008 | Freedman | 280/642 |
| 7,431,388 | B2 * | 10/2008 | Sharapov | 297/184.11 |
| D594,241 | S | 6/2009 | Bergmann et al. | D6/361 |
| D595,060 | S | 6/2009 | Van Duysen | D6/361 |
| D608,554 | S | 1/2010 | Aoki | D6/361 |
| 7,768,154 | B2 * | 8/2010 | Taylor et al. | 307/82 |
| D630,031 | S | 1/2011 | Van Duysen | D6/361 |
| 2005/0242635 | A1 * | 11/2005 | Cassaday | 297/217.3 |
| 2006/0054207 | A1 | 3/2006 | Wootliff | 135/96 |
| 2010/0283295 | A1 * | 11/2010 | Smith et al. | 297/16.2 |

FOREIGN PATENT DOCUMENTS

| | | | |
|---|---|---|---|
| GB | 2239592 A | * | 7/1991 |
| JP | 2008010522 | * | 1/2008 |

* cited by examiner

CHAIR PROVISION WITH AN APPARATUS FOR CONVERTING SOLAR ENERGY TO POWER ELECTRICAL DEVICES

BACKGROUND OF THE INVENTION

1. Field of the Invention

The present invention relates to a solar power system, and more particularly, a chair provision with an apparatus for converting solar energy to power electrical devices.

2. Description of the Prior Art

Numerous innovations for electrical power charging devices have been provided in the prior art that will be described. Even though these innovations may be suitable for the specific individual purposes to which they address, however, they differ from the present invention.

A FIRST EXAMPLE, U.S. Pat. No. 4,379,588, Issued on Apr. 12, 1983, to Speice teaches a solar lounger which rotates in response to energization from the sun's rays. The solar lounger has a chaise type chair which is rotatably supported on a base. Photovoltaic solar cells are mounted on said chair and generate electrical energy in response to the sun's rays. The electrical energy is used to power a drive motor which causes the chair to rotate relative to the base.

A SECOND EXAMPLE, U.S. Pat. No. 5,090,770, Issued on Feb. 25, 1992, to Heinrichs et al. teaches an item of seating furniture, particularly an office chair, comprising at least one seat adjusting device, for example for adjusting the height of the seat, with a spring element engaging the two parts of the seat which are to be adjusted in respect of each other, particularly a pressurized fluid filled spring, and with a locking device for the separable fixing of the two seat parts in whatever is the desired and selected adjusted position, the use of an electrical actuating element for the locking device is proposed, which is connected to a manually operable control means for the at least one seat adjustment, this allowing simplified operation with minimal structural expenditure.

A THIRD EXAMPLE, U.S. Pat. No. 5,897,163, Issued on Mar. 27, 1999, to Singer teaches a suntanning apparatus that comprises a plurality of chairs preferably of the lounge type which are mounted on a rotating platform which follows the sun's path. The platform rotates in accordance with a predetermined program and can vary in size to accommodate a predetermined plurality of lounge chairs. The platform is driven by a motor which is coupled to the platform to rotate the platform about a central axis. The motor is coupled to a computer which determines the movement of the platform so that the chairs are always facing towards the sun. In an alternate embodiment, a pair of lounge chairs are mounted on a rotatable platform with controls mounted therebetween for individuals to operate the drive motor to rotate the platform in accordance with the sun's rays.

A FOURTH EXAMPLE, U.S. Pat. No. 5,975,630, Issued on Nov. 2, 1999, to Schreiber teaches a lounge chair having a sun tracking positioning mechanism including at least one photo transistor having a lens for focusing sunlight in a straight line path passing through the lens and comprising a motor control circuit that allows a motor to operate for periods of no more than 30 seconds. Should the motor operate for a 30 second period, the system will deactivate. This 30 second cutout allows for controlling of shade times such as when the sun is behind clouds or the like.

A FIFTH EXAMPLE, U.S. Pat. No. 6,737,830, Issued on May 18, 2004, to Bean et al teaches a battery charger which provides remote or untethered charging of a rechargeable battery. The battery charger provides untethered charging either in situ within a battery-powered device or external to the device. The battery charger comprises a power converter and an energy storage device connected to the power converter. A battery charging system comprises the battery charger and independent electrical connection devices. One connection device connects the battery charger to an external energy source to acquire energy that is stored in the storage device. Another connection device connects the battery charger to a battery for charging. The connection devices are independent and battery charging is untethered in that the battery charger need not be connected to the external energy source while the battery charger charges the battery. A method of charging the battery comprises charging the battery with energy stored in a portable energy storage device.

A SIXTH EXAMPLE, U.S. Patent Publication No. 20050242635, Published on Nov. 3, 2005, to Cassaday teaches a chair, bed, lounge or other similar type structure that has electrical functions or features and also has an energy converter, which produces electrical power from conditions to which the structure is exposed on a regular basis to power the functions or features.

It is apparent now that numerous innovations for electrical power charging devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a chair provision with an apparatus for converting solar energy to power electrical devices that avoids the disadvantages of the prior art.

ANOTHER OBJECT of the present invention is to provide a chair provision with an apparatus for converting solar energy to power electrical devices that is simple and inexpensive to manufacture.

STILL ANOTHER OBJECT of the present invention is to provide a chair provision with an apparatus for converting solar energy to power electrical devices that is simple to use.

BRIEFLY STATED, STILL YET ANOTHER OBJECT of the present invention is to provide a chair provisioned with an apparatus for converting solar energy to power electrical devices which comprises the chair having a seat member and a backrest member to support a person thereon. A mechanism stored in the chair, is for converting the solar energy into electrical energy. At least one socket in the chair is electrically connected to the solar energy converting mechanism, wherein at least one of the electrical devices can plug into the at least one socket to receive the electrical energy therefrom.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
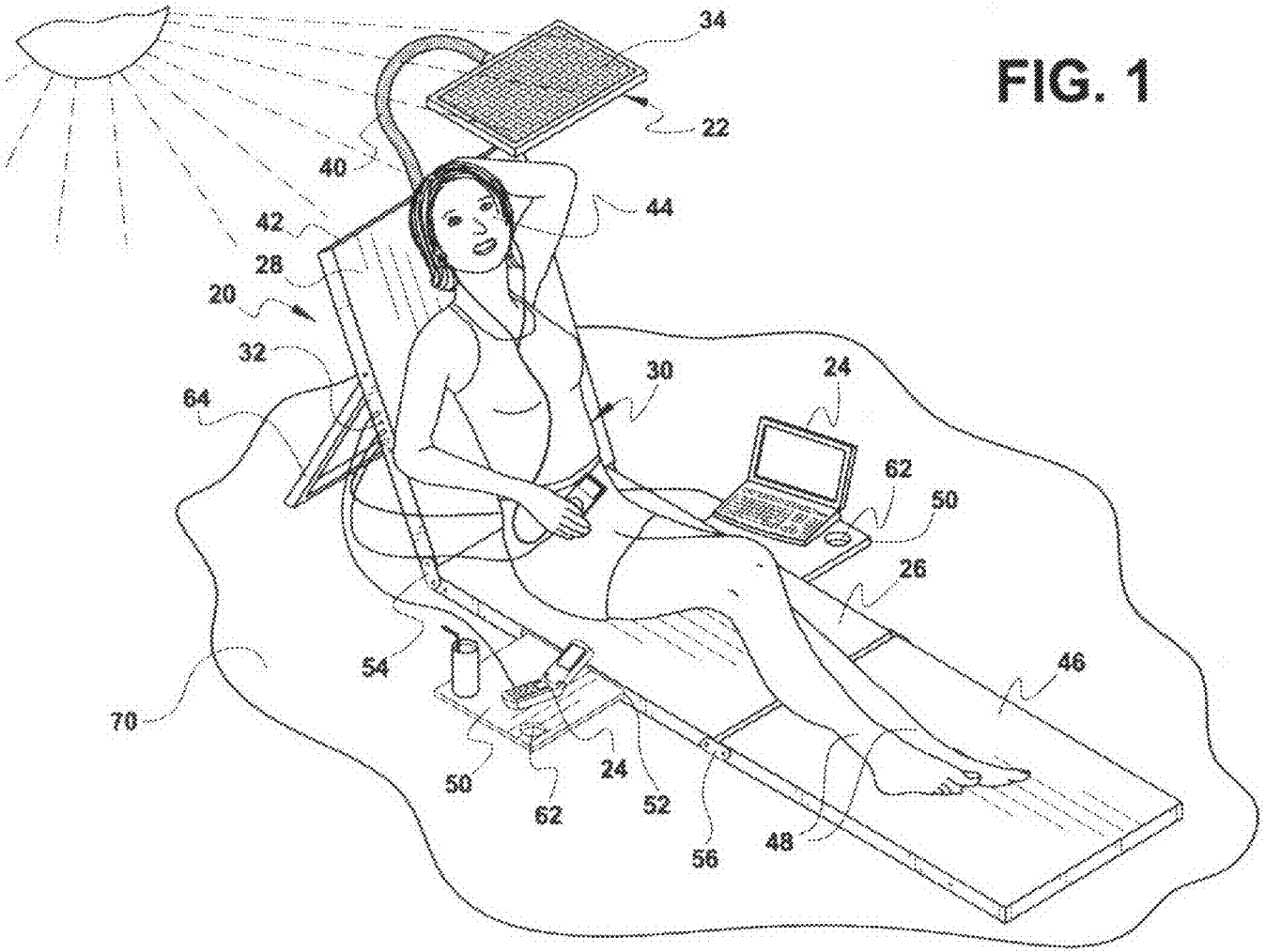
FIG. 1 is a diagrammatic front perspective view of an embodiment of the present invention in use.

| | |
|---|---|
| 20 | chair |
| 22 | solar energy converting apparatus |
| 24 | electrical device |
| 26 | seat member of chair 20 |
| 28 | backrest member of chair 20 |
| 30 | person |
| 32 | socket in chair 20 |
| 34 | solar panel of solar energy converting apparatus 22 |
| 36 | inverter of solar energy converting apparatus 22 |
| 38 | rechargeable battery in solar energy converting apparatus 22 |
| 40 | goose neck of solar panel 34 |
| 42 | top of backrest member 28 |
| 44 | head of person 30 |
| 46 | leg rest member of chair 20 |
| 48 | leg of person 30 |
| 50 | tray member of chair 20 |
| 52 | side track in seat member 26 |
| 54 | first hinge assembly in chair 20 |
| 56 | second hinge assembly in chair 20 |
| 58 | handle of tray assembly 50 |
| 60 | stop of tray member 50 |
| 62 | built-in cup holder in tray member 50 |
| 64 | backrest leg of chair 20 |
| 66 | extension leg of chair 20 |
| 68 | stub leg of chair 20 |
| 70 | support surface |

DETAILED DESCRIPTION OF THE PREFERRED EMBODIMENT

Figure 3:
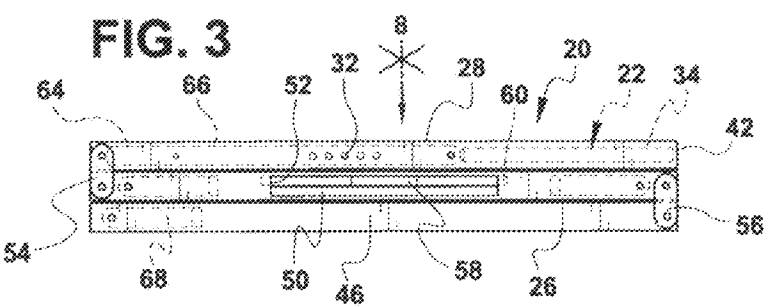
FIG. 3 is a diagrammatic side view of the present invention folded up and ready for carrying.
Figure 2:
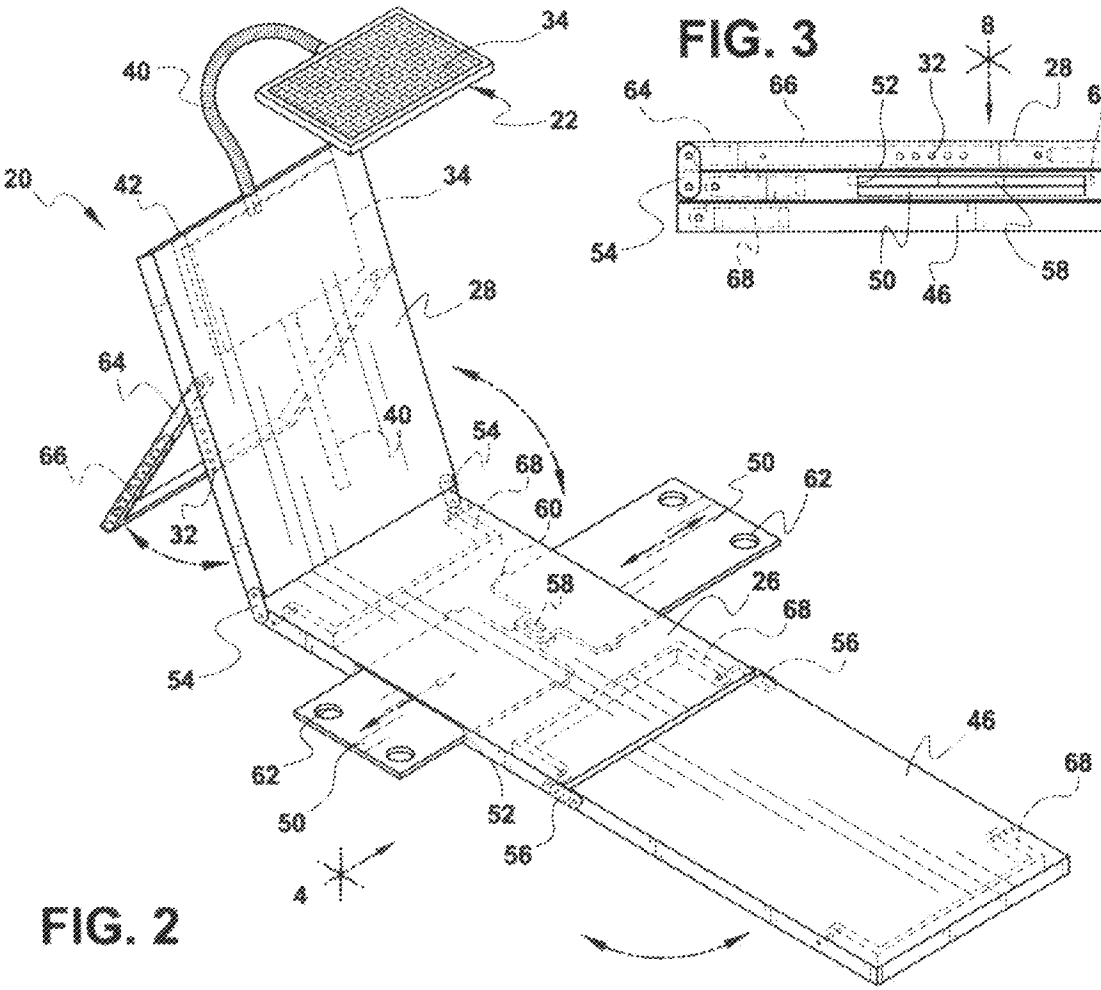
FIG. 2 is a diagrammatic front perspective view, similar to FIG. 1, of the present invention per se.
Figure 4:
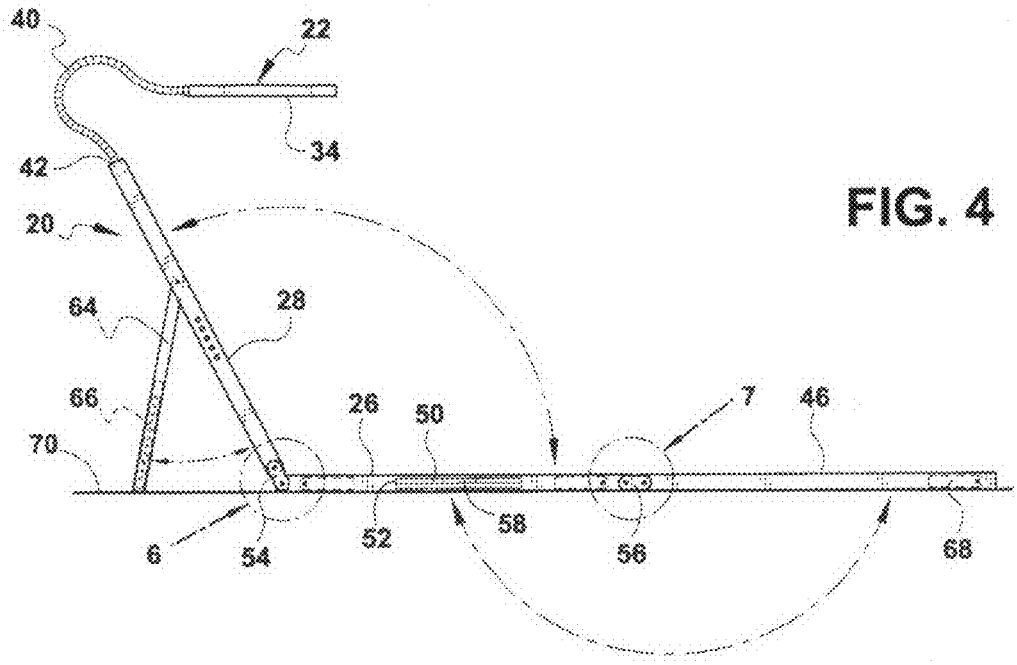
FIG. 4 is a diagrammatic side view taken in the direction of arrow 4 in FIG. 2.
Figure 5:
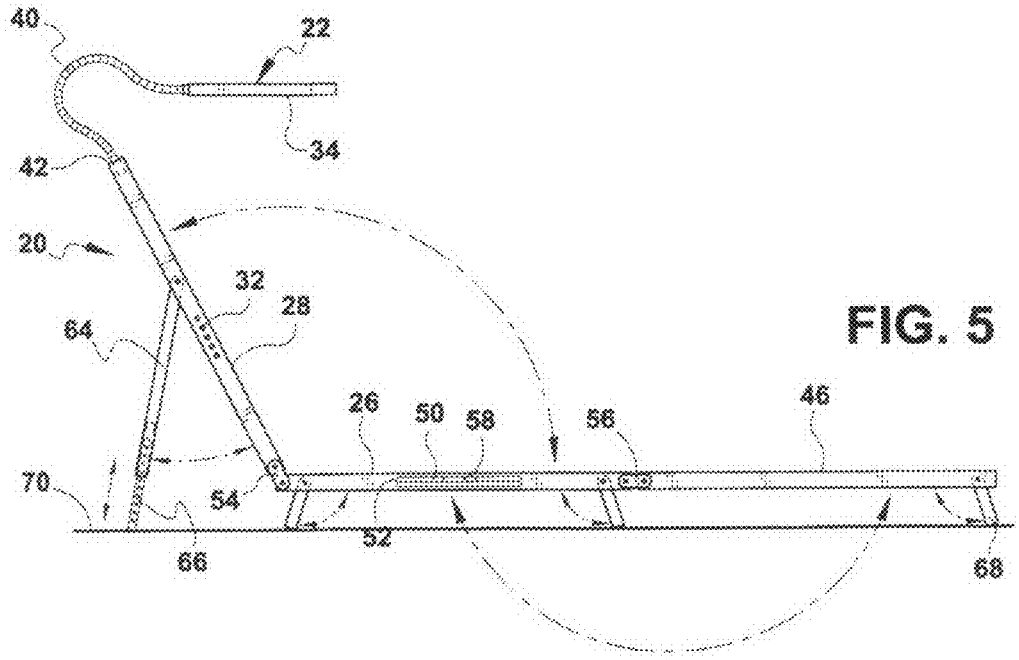
FIG. 5 is a diagrammatic side view, similar to FIG. 4, with the stub legs unfolded and the extension legs extended.
Figure 6:
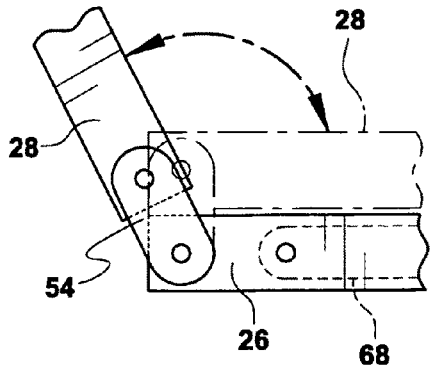
FIG. 6 is an enlarged diagrammatic side view of the area enclosed in the dotted circle indicated by arrow 6 in FIG. 4.
Figure 7:
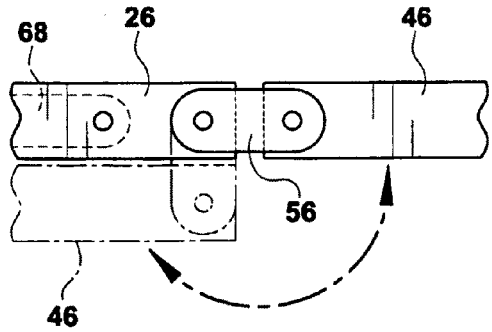
FIG. 7 is an enlarged diagrammatic side view of the area enclosed in the dotted circle indicated by arrow 7 in FIG. 4.
Figure 8:
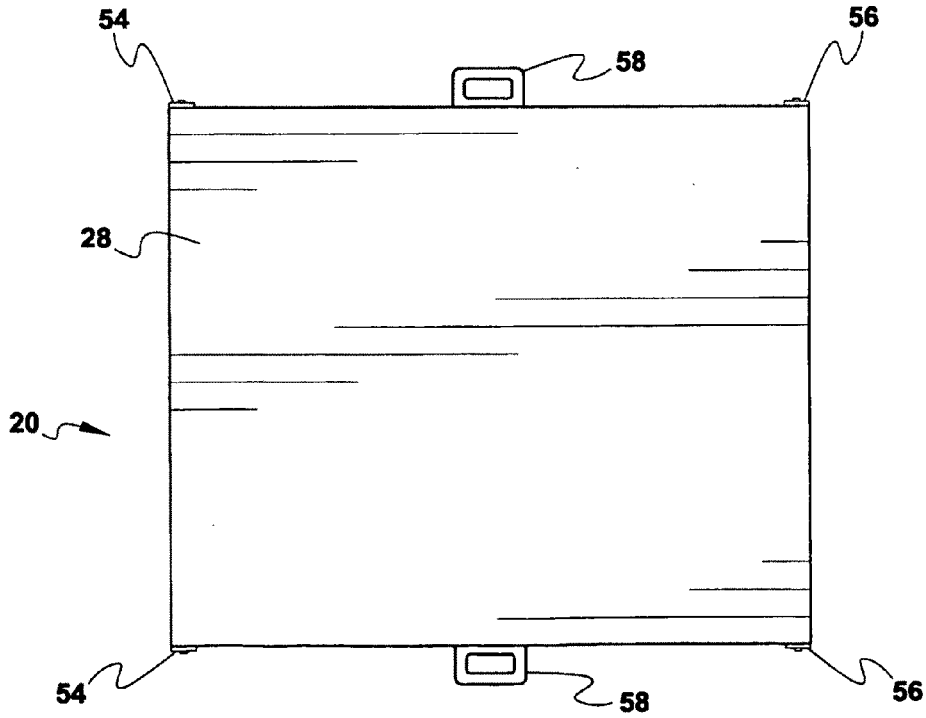
FIG. 8 is a diagrammatic top view taken in the direction of arrow 8 in FIG. 3.
Figure 10:
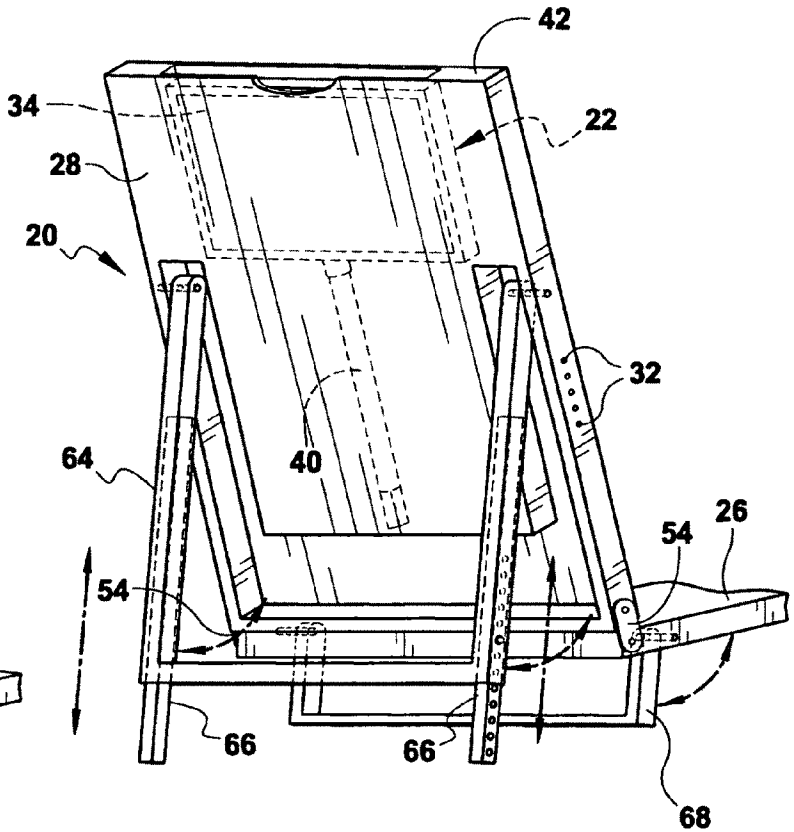
FIG. 10 is a diagrammatic rear perspective view, with parts broken away, similar to FIG. 9 with the solar panel completely inserted into the backrest member, with one stub leg unfolded and the extension legs extended as in FIG. 5.
Figure 9:
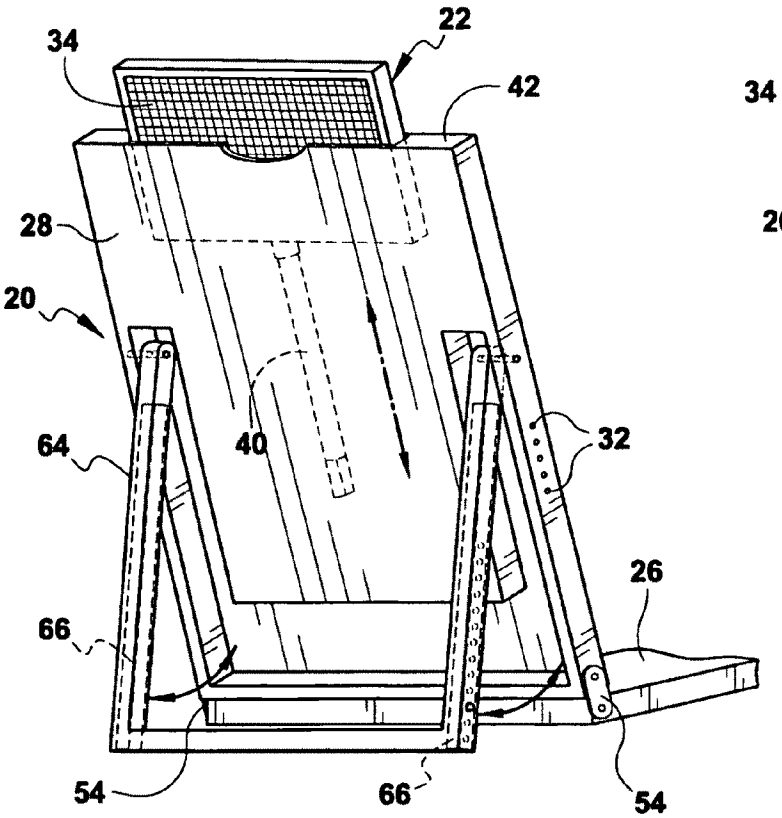
FIG. 9 is a diagrammatic rear perspective view, with parts broken away, taken in the direction of arrow 9 in FIG. 2, with the solar panel partly inserted into the backrest member.
Figures 11, 12:
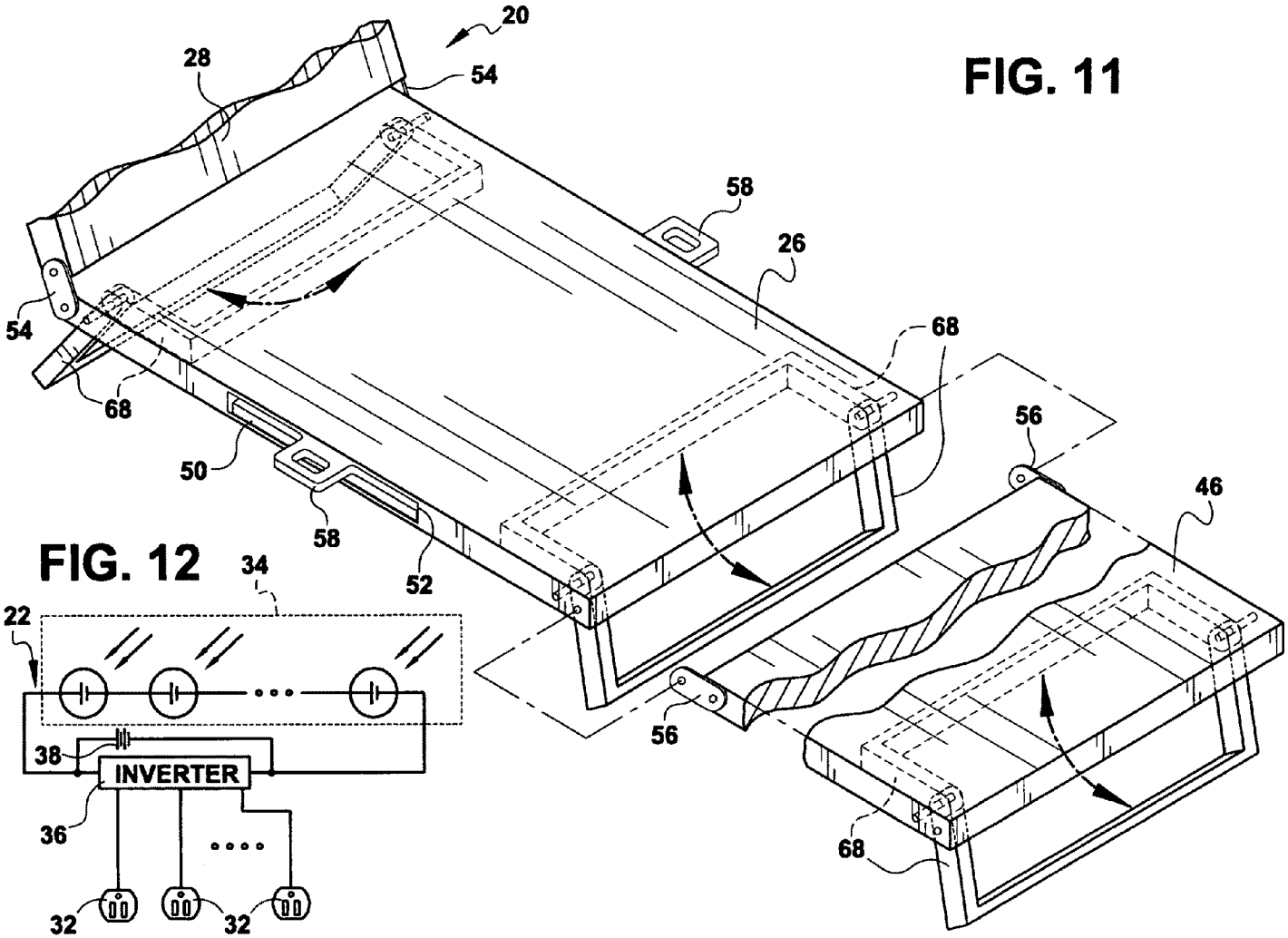
FIG. 11 is an enlarged diagrammatic front perspective view, with parts broken away, showing the leg rest member exploded therefrom and the stub legs unfolded as in FIG. 5.
FIG. 12 is a diagrammatic electrical block diagram of the solar energy converting apparatus of the present invention.
Figures 13, 14:
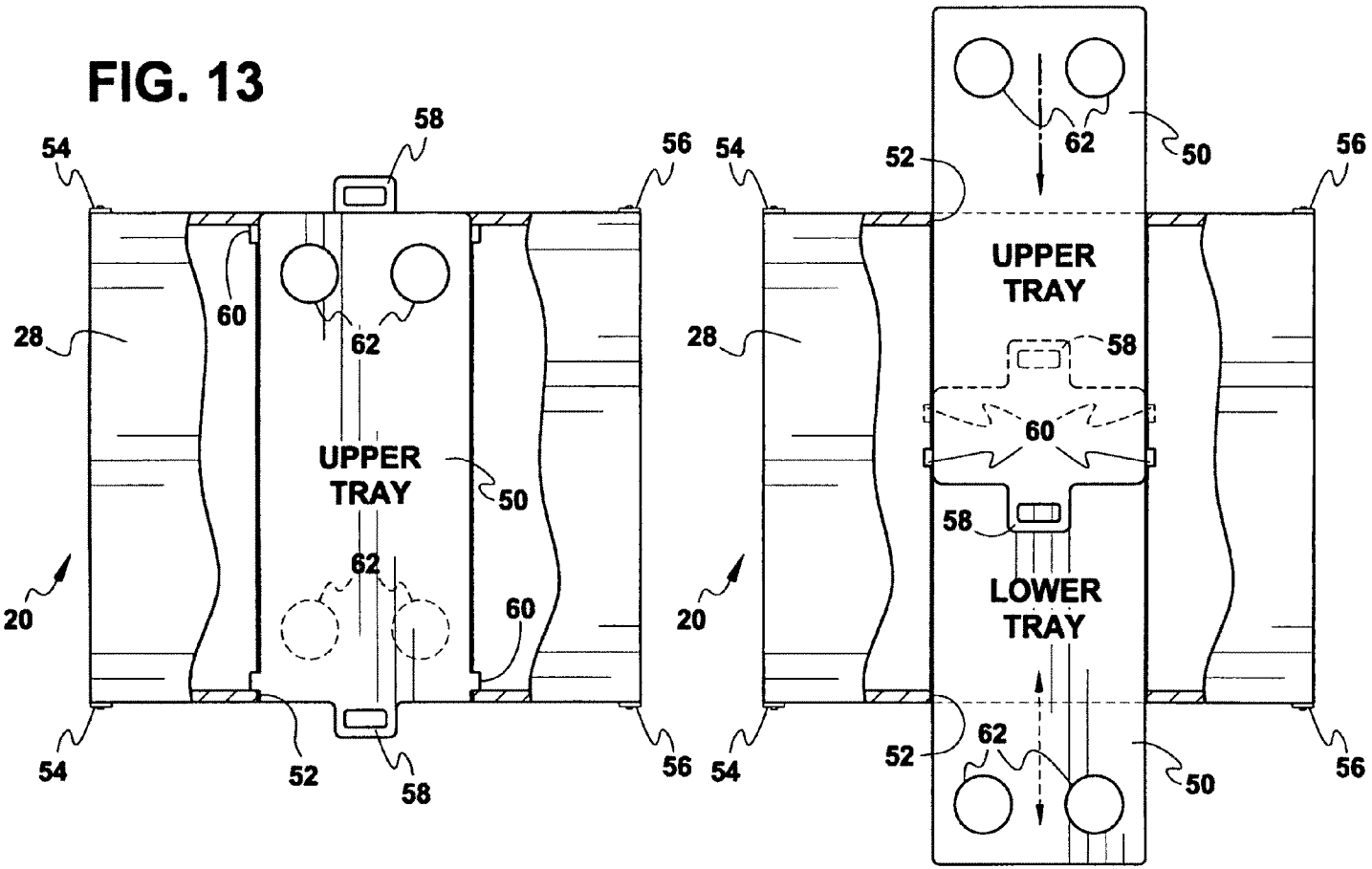
FIG. 13 is a diagrammatic top view similar to FIG. 8, with parts broken away, showing the tray members in a stowed away position.
FIG. 14 is a diagrammatic top view similar to FIG. 13, showing the tray members in a withdrawn position.

Referring now to the figures, in which like numerals indicate like parts, and particularly to FIGS. 1 through 14, which are a diagrammatic front perspective view of an embodiment of the present invention in use; a diagrammatic front perspective view, similar to FIG. 1, of the present invention per se; a diagrammatic side view of the present invention folded up and ready for carrying; a diagrammatic side view taken in the direction of arrow 4 in FIG. 2; a diagrammatic side view, similar to FIG. 4, with the stub legs unfolded and the extension legs extended; an enlarged diagrammatic side view of the area enclosed in the dotted circle indicated by arrow 6 in FIG. 4; an enlarged diagrammatic side view of the area enclosed in the dotted circle indicated by arrow 7 in FIG. 4; a diagrammatic top view taken in the direction of arrow 8 in FIG. 3; a diagrammatic rear perspective view, with parts broken away, taken in the direction of arrow 9 in FIG. 2, with the solar panel partly inserted into the backrest member; a diagrammatic rear perspective view, with parts broken away, similar to FIG. 9 with the solar panel completely inserted into the backrest member, with one stub leg unfolded and the extension legs extended as in FIG. 5; an enlarged diagrammatic front perspective view, with parts broken away, showing the leg rest member exploded therefrom and the stub legs unfolded as in FIG. 5; a diagrammatic electrical block diagram of the solar energy converting apparatus of the present invention; a diagrammatic top view similar to FIG. 8, with parts broken away, showing the tray members in a stowed away position; and a diagrammatic top view similar to FIG. 13, showing the tray members in a withdrawn position, and as such, will be discussed with reference thereto.

The present invention is a chair 20 provisioned with an apparatus 22 for converting solar energy to power electrical devices 24, such as laptops, Ipods, phones and the like. The chair 20 has a seat member 26 and a backrest member 28 to support a person 30 thereon. The apparatus 22 is stored in the chair 20, for converting the solar energy into electrical energy. At least one socket 32 in the chair 20 is electrically connected to the solar energy converting apparatus 22, wherein at least one of the electrical devices 24 can plug into the at least one socket 32 to receive the electrical energy therefrom.

The solar energy converting apparatus 22 comprises a solar panel 34. An inverter 36 is electrically connected between the solar panel 34 and the at least one socket 32. A rechargeable battery 38 is electrically connected between the solar panel 34 and the inverter 36. The solar panel 34 comprises a telescopic goose neck 40 extending up from top 42 of the backrest member 28 of the chair 20. The solar panel 34 can be adjusted for use over head 44 of the person 30 sitting on the seat member 26 of the chair 20. The solar panel 34 can be stored within the backrest member 28 of the chair 20 when not in use.

The chair 20 further comprises a leg rest member 46 connected to the seat member 26 to support the legs 48 of the person 30, thereby converting the chair 20 into a chaise lounge. At least one tray member 50 is slidably stored within a side track 52 in the seat member 26. When the at least one tray member 50 is extended from the seat member 26 the at least one electrical device 24 can be supported on the at least one tray member 50. A first hinge assembly 54 is between the backrest member 28 and the seat member 26. A second hinge assembly 56 is between the seat member 26 and the leg rest member 46, wherein the chair 20 can be folded up for storage.

The at least one tray member 50 comprises a handle 58 and stops 60. The stops 60 will prevent the at least one tray member 50 from leaving the side track 52 in the seat member 26, thereby allowing the person 30 to carry the chair 20 by the handle 58 when the chair 20 is folded up. The at least one tray member 50 further comprises at least one built-in cup holder 62.

The chair 20 further comprises a foldable backrest leg 64 to support the backrest member 28 of the chair 20 in a reclined position. A pair of extendable extension legs 66 are on the foldable backrest leg 64. A plurality of foldable stub legs 68 are on the seat member 26 and the leg rest member 46 to elevate the chair 20 above a support surface 70, such as the ground or a floor.

It will be understood that each of the elements described above, or two or more together, may also find a useful application in other types of constructions differing from the types described above.

While the invention has been illustrated and described as embodiments of a chair provision with an apparatus for converting solar energy to power electrical devices, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A chair provisioned with an apparatus for converting solar energy to power electrical devices which comprises:

a) said chair having a seat member and a backrest member to support a person thereon;

b) means stored in said chair, for converting the solar energy into electrical energy; and c) at least one socket in said chair electrically connected to said solar energy converting means, wherein at least one of the electrical devices can plug into said at least one socket to receive the electrical energy therefrom, wherein said solar energy converting means comprises:

A) a solar panel;

B) an inverter electrically connected between said solar panel and said at least one socket; and C) a rechargeable battery electrically connected between said solar panel and said inverter, wherein said solar panel comprises a telescopic goose neck extending up from top of said backrest member of said chair, wherein said solar panel can be adjusted for use over head of the person sitting on said seat member of said chair and said solar panel can be stored within said backrest member of said chair when not in use.

2. The chair as recited in claim 1, further comprising a leg rest member connected to said seat member to support the legs of the person, thereby converting said chair into a chaise lounge.

3. The chair as recited in claim 2, further comprising at least one tray member slidably stored within a side track in said seat member, wherein when said at least one tray member is extended from said seat member the at least one electrical device can be supported on said at least one tray member.

4. The chair as recited in claim 3, further comprising:

a) a first hinge assembly between said backrest member and said seat member; and b) a second hinge assembly between said seat member and said leg rest member, wherein said chair can be folded up for storage.

5. The chair as recited in claim 4, wherein said at least one tray member comprises a handle and stops, wherein said stops will prevent said at least one tray member from leaving said side track in said seat member, thereby allowing the person to carry said chair by said handle when said chair is folded up.

6. The chair as recited in claim 5, wherein said at least one tray member further comprises at least one built-in cup holder.

7. The chair as recited in claim 6, further comprising a foldable backrest leg to support said backrest member of said chair in a reclined position.

8. The chair as recited in claim 7, further comprising:

a) a pair of extendable extension legs on said foldable backrest leg; and b) a plurality of foldable stub legs on said seat member and said leg rest member to elevate said chair above a support surface.

* * * * *